US006061536A

United States Patent [19]

Cho et al.

[11] Patent Number: 6,061,536

[45] Date of Patent: May 9, 2000

[54] AIR CIRCULATION SYSTEM FOR LIQUID-TYPE ELECTROPHOTOGRAPHIC PRINTER

[75] Inventors: Min-su Cho, Incheon; Kwang-ho No, Sungnam, both of Rep. of Korea

[73] Assignee: Samsung Electronics Co. Ltd., Kyungki-do, Rep. of Korea

[21] Appl. No.: 09/417,365

[22] Filed: Oct. 13, 1999

[30] Foreign Application Priority Data

Nov. 18, 1998 [KR] Rep. of Korea ..... 98-49478

[51] Int. Cl.[7] ..... G03G 21/00; G03G 15/10

[52] U.S. Cl. ..... 399/92; 399/93

[58] Field of Search ..... 399/92, 93, 343, 399/355

[56] References Cited

U.S. PATENT DOCUMENTS

| | | | |
|---|---|---|---|
| 5,878,305 | 3/1999 | Suzumura et al. | 399/97 |
| 5,905,928 | 8/1999 | Shin | 399/250 |
| 5,946,528 | 8/1999 | Cho | 399/93 |

*Primary Examiner*—Arthur T. Grimley
*Assistant Examiner*—Remmon R. Forde'
*Attorney, Agent, or Firm*—Sughrue, Mion, Zinn, Macpeak & Seas, PLLC

[57] ABSTRACT

An air circulation system for a liquid-type electrophotographic printer. The air circulation system circulates air in the printer and discharges the air to the outside. The printer includes a developer unit for developing a predetermined image onto a photoreceptor belt, a drying unit for drying the developed image, and a transfer unit for printing the dried image on a paper. The air circulation system includes: a belt cartridge having access openings and which is detachably installed in the printer to enclose the photoreceptor belt, except for portions of the photoreceptor belt to which the developer unit, the drying unit and the transfer unit have access through the access openings; sealing members for sealing the belt cartridge at the access openings to the photoreceptor belt for accessing by the developer unit, the drying unit and the transfer unit; a pump for sucking out air in the space enclosed by the belt cartridge and discharging the air to the outside; and a filter for filtering out harmful fumes from the air sucked by the pump prior to being discharged to the outside.

2 Claims, 2 Drawing Sheets

AIR CIRCULATION SYSTEM FOR LIQUID-TYPE ELECTROPHOTOGRAPHIC PRINTER

BACKGROUND OF THE INVENTION

1. Field of the Invention

The present invention relates to an improved air circulation system for liquid-type electrophotographic printers and which is capable of saving energy for air circulation.

2. Description of the Related Art

As shown in FIG. 1, a liquid-type electrophotographic printer, for example, a color laser printer, includes a developer unit 20 for developing a latent electrostatic image formed onto a photoreceptor belt 10, a drying unit 40 for drying the developed image, and a transfer unit 30 for printing the image which has been developed and dried, on a paper. Such units are essential portions for a printing process, and are collectively called the engine of the printer. The engine is enclosed by a shield 50 in order to prevent foreign materials that are hazards to humans, from being discharged to the outside. The shield 50 has a discharge portion 51 connected to an air pump 80, and the air in the space enclosed by the shield 50 is discharged to the outside of the printer via the discharge portion 51. In FIG. 1, reference numeral 90 represents a filter for filtering out harmful fumes. In general, the harmful fumes in the space enclosed by the shield layer is generated by evaporation of carrier contained in a development solution by contact with the high-temperature photoreceptor belt 10, during the development, drying and transferring processes.

Meanwhile, the developer unit 20 includes a development roller 24 for developing a latent electrostatic image formed onto the photoreceptor belt 10 using a development solution containing a powdered toner and a solvent in a predetermined ratio, and a squeeze roller 21 and an air spray portion 22 which are for removing excessive development solution from the photoreceptor belt 10. The squeeze roller 21 presses the photoreceptor belt 10 to squeeze the solvent. The air spray portion 22 sprays air in order to prevent the squeezed solvent from flowing along the traveling direction of the photoreceptor belt 10, such that the solvent falls into the developer unit 20. In this case, a part of the air which is discharged by the air pump 80 is reused as a source of the air used by the air spray portion 22.

However, most harmful materials floating in the air that circulates in the space of the printer or is discharged therefrom, are generated by evaporation of the solvent contained in the development solution. Mostly, such evaporation of the solvent occurs at the photoreceptor belt 10. That is, the solvent is evaporated by the photoreceptor belt 10 that has been heated through the development, drying and transferring processes.

However, in the case of adopting the above structure, the shield 50 encloses all of the developer unit 20, the drying unit 40 and the transfer unit 30, in addition to the photoreceptor belt 10 that is the major origin of evaporated harmful solvent, thus the capacity of the air pump 80 for sucking air from such a large space enclosed by the shield 50 increases. Accordingly, energy consumption also increases by as much as the capacity of the air pump.

SUMMARY OF THE INVENTION

An object of the present invention is to provide an improved air circulation system for liquid-type electrophotographic printers and which is capable of saving energy for air circulation.

To achieve the object of the present invention, there is provided an air circulation system for a liquid-type electrophotographic printer, for circulating air in the printer and discharging the air to the outside, the printer, including a developer unit for developing a predetermined image onto a photoreceptor belt, a drying unit for drying the developed image, and a transfer unit for printing the dried image on a paper. The air circulation system comprises: a belt cartridge having access openings and which is detachably installed in the printer to enclose the photoreceptor belt, except for portions of the photoreceptor belt to which the developer unit, the drying unit, and the transfer unit have access through the access openings; sealing members for sealing the belt cartridge at the access openings to the photoreceptor belt for accessing by the developer unit, the drying unit and the transfer unit; a pump for sucking out air in a space enclosed by the belt cartridge and discharging the air to the outside; and a filter for filtering out harmful fumes from the air sucked by the pump prior to being discharged to the outside.

BRIEF DESCRIPTION OF THE DRAWINGS

The above object and advantages of the present invention will become more apparent by describing in detail a preferred embodiment thereof with reference to the accompanying drawings, in which.

DETAILED DESCRIPTION OF THE PREFERRED EMBODIMENTS

Figure 2:
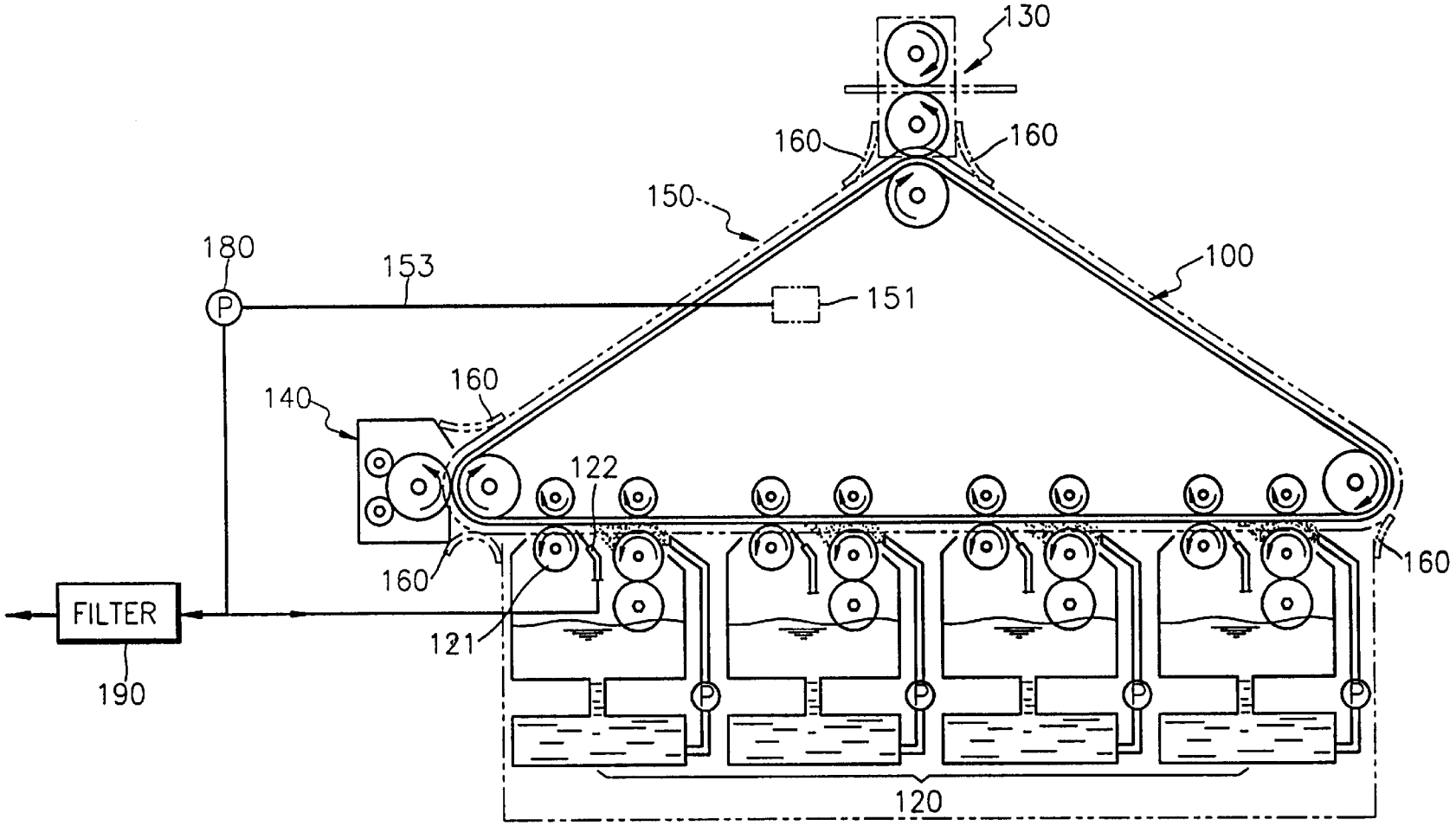
FIG. 2 is a diagram of an air circulation system for a liquid-type electrophotographic printer according to a preferred embodiment of the present invention.

As shown in FIG. 2, in an air circulation system for a liquid-type electrophotographic printer according to a preferred embodiment of the present invention, a photoreceptor belt 100, the origin of evaporated harmful solvent, is enclosed by a belt cartridge 150 having a shielding function. The belt cartridge 150 has access openings so as to be partially open such that a developer unit 120 for developing a latent electrostatic image, a drying unit 140 for drying the developed image, and a transfer unit 130 for printing the dried image on a paper all have access to the photoreceptor belt 100 through the access openings. As a result, in the absence of some type of seal, air would leak from the space enclosed by the belt cartridge 150 at the access openings thereof. For sealing the leaks to prevent the harmful fumes from leaking, sealing members 160 are attached to each of the access openings of the belt cartridge 150. The sealing members 160 are flexibly attached to connect the developer unit 120, the drying unit 140 and the transfer unit 130 to the belt cartridge 150, thereby completely sealing the leaks.

In the air circulation system, a discharge portion 151, through which the harmful fumes are discharged to the outside, is formed at a side of the belt cartridge 150. The discharge portion 151 is connected to an air pump 180 via a path 153. Also, a filter 190 for filtering out harmful fumes from air sucked by the air pump 180 prior to being discharged to the outside is installed on the path 153.

That is, the air is sucked from the inside of the belt cartridge 150 closely enclosing the photoreceptor belt 100 by operating the air pump 180, filtered by the filter 190 and then discharged. Also, a part of the air sucked by the air pump 180 is supplied to an air spray portion 122 of the developer unit 120, which drops the solvent squeezed by a squeeze roller 121 into a development solution container placed in the lower portion of the developer unit 120.

Figure 1:
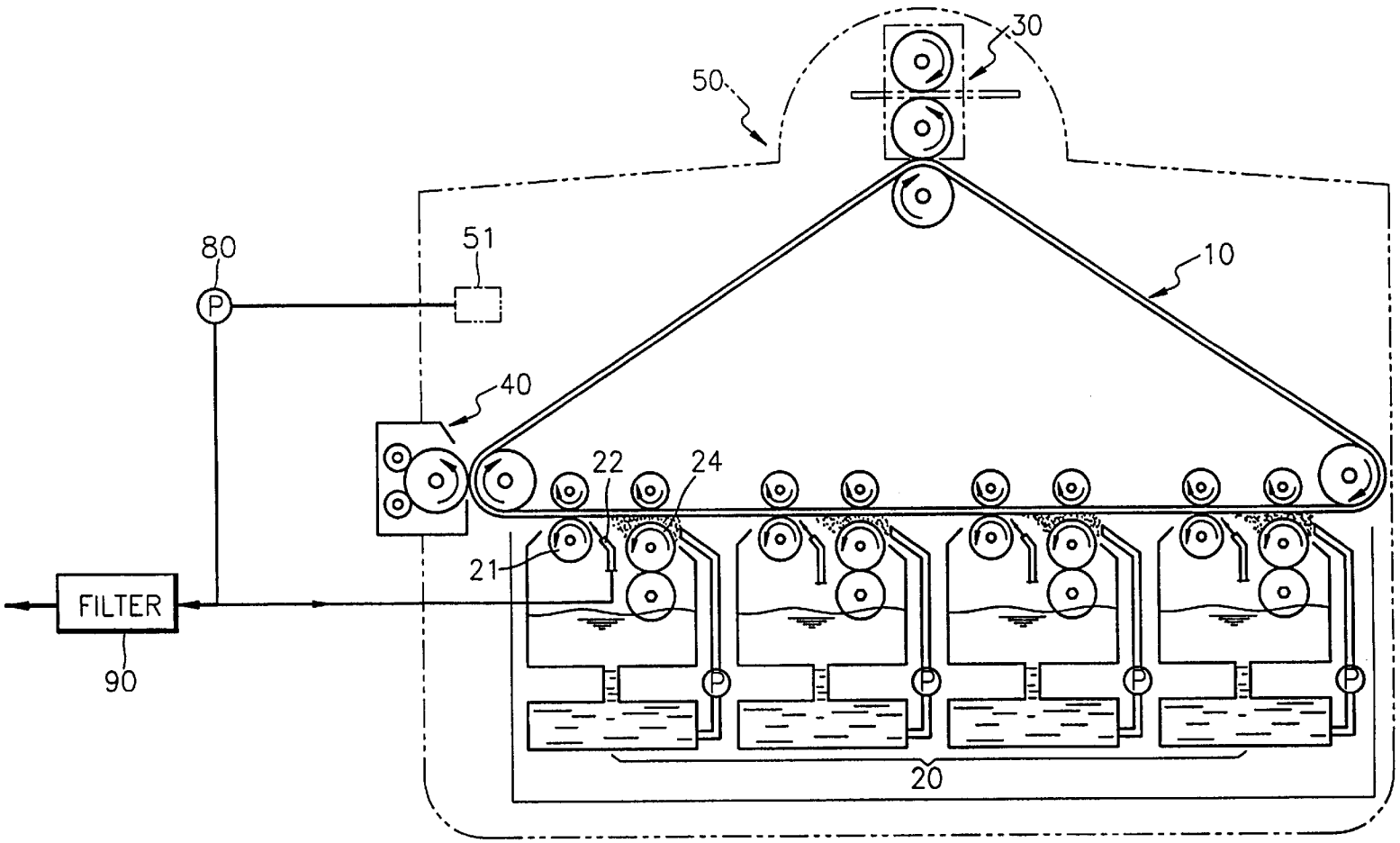
FIG. 1 (PRIOR ART)
FIG. 1 is a schematic view of a conventional air circulation system for a liquid-type electrophotographic printer.

As described above, in the air circulation system for a liquid-type electrophotographic printer according to the present invention, the belt cartridge 150 having a shielding function is installed to closely follow the contours of the photoreceptor belt 100 and closely encloses the photoreceptor belt 100, and the inner space is sealed by the sealing members 160, thereby minimizing the space enclosed by the belt cartridge 150 and allowing a lowering of the capacity of the pump 180 for discharging the harmful fumes generated in the space enclosed by the belt cartridge 150 to the outside of the printer. Thus, the air circulation system according to the present invention is smaller than a conventional air circulation system adopting the shield 50 (see FIG. 1) which encloses all of the developer unit, the drying unit and the transfer unit, and the capacity of the air pump 180 can be reduced, in addition to saving energy required therefor.

It is contemplated that numerous modifications may be made to the air circulation system for liquid-type electrophotographic printer of the present invention without departing from the spirit and scope of the invention as defined in the following claims.

What is claimed is:

1. An air circulation system for a liquid-type electrophotographic printer, for circulating air in the printer and discharging the air to the outside, the printer including a developer unit for developing a predetermined image onto a photoreceptor belt, a drying unit for drying the developed image, and a transfer unit for printing the dried image on a paper, the air circulation system comprising:

a belt cartridge having access openings and which is detachably installed in the printer to enclose the photoreceptor belt, except for portions of the photoreceptor belt to which the developer unit, the drying unit, and the transfer unit have access through the access openings;

sealing members for sealing the belt cartridge at the access openings to the photoreceptor belt for accessing by the developer unit, the drying unit and the transfer unit;

a pump for sucking out air in a space enclosed by the belt cartridge and discharging the air to the outside; and a filter for filtering out harmful fumes from the air sucked by the pump prior to being discharged to the outside.

2. The air circulation system as claimed in claim 1, wherein the belt cartridge closely follows contours of the photoreceptor belt thereby minimizing the space enclosed by the belt cartridge.

* * * * *